US012188674B2

(12) United States Patent
Notaro et al.

(10) Patent No.: US 12,188,674 B2
(45) **Date of Patent: *Jan. 7, 2025**

(54) SYSTEMS AND METHODS FOR AIR TEMPERATURE CONTROL USING A TARGET TIME BASED CONTROL PLAN

(71) Applicant: Goodman Manufacturing Company LP, Houston, TX (US)

(72) Inventors: Douglas Notaro, Cypress, TX (US); Jim Fisher, Houston, TX (US)

(73) Assignee: Goodman Manufacturing Company LP, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/317,213

(22) Filed: May 15, 2023

(65) Prior Publication Data

US 2023/0280066 A1 Sep. 7, 2023

Related U.S. Application Data

(60) Division of application No. 17/139,153, filed on Dec. 31, 2020, now Pat. No. 11,686,494, which is a (Continued)

(51) Int. Cl.
*F24F 11/64* (2018.01)
*F24F 11/30* (2018.01)
(Continued)

(52) U.S. Cl.
CPC ..... *F24F 11/64* (2018.01); *F24F 11/30* (2018.01); *F24F 11/58* (2018.01); *F24F 11/62* (2018.01); *F24F 11/61* (2018.01); *F24F 2110/10* (2018.01)

(58) Field of Classification Search
CPC .. F24F 11/64; F24F 11/30; F24F 11/58; F24F 11/62; F24F 11/61; F24F 2110/10
See application file for complete search history.

(56) References Cited

U.S. PATENT DOCUMENTS 5,312,674 A * 5/1994 Haertling ..... H05K 1/165 428/209
6,176,436 B1 * 1/2001 Gauthier ..... F24F 11/62 62/157
(Continued)

FOREIGN PATENT DOCUMENTS

JP 2009-014246 A 1/2009
JP 5312674 B2 10/2013
(Continued)

OTHER PUBLICATIONS

"Installation Instructions—Modulating, 35" Tall High Efficiency Condensing Gas Furnace, F97CMN and G97CMN (Series A)", International Comfort Products, Jan. 29, 2019, 95 pages.
(Continued)

*Primary Examiner* — Ramesh B Patel
(74) *Attorney, Agent, or Firm* — Baker Botts L.L.P.

(57) ABSTRACT

A system and method for controlling the air temperature of a building using a control plan based on a target time. The system includes a controller which may be connected to a number of indoor and outdoor heating ventilation and air-conditioning units. The system may include a thermostat. The system may also operate without a thermostat. The method includes determining a control plan to reach a desired temperature in a target time. The method also includes updating the plan by comparing the actual time to reach the desired temperature with the target time.

20 Claims, 3 Drawing Sheets

Related U.S. Application Data continuation of application No. 16/832,618, filed on Mar. 27, 2020, now Pat. No. 11,435,099, which is a division of application No. 15/043,134, filed on Feb. 12, 2016, now Pat. No. 10,641,508.

(51) Int. Cl.

| | |
|---|---|
| ***F24F 11/58*** | (2018.01) |
| ***F24F 11/62*** | (2018.01) |
| *F24F 11/61* | (2018.01) |
| *F24F 110/10* | (2018.01) |

(56) References Cited

U.S. PATENT DOCUMENTS

| | | | | |
|---|---|---|---|---|
| 7,243,004 | B2 * | 7/2007 | Shah | F24F 11/30 |
| 7,775,452 | B2 * | 8/2010 | Shah | G05D 23/1905 |
| 9,253,260 | B1 * | 2/2016 | Bailey | H04L 67/125 |
| 9,822,989 | B2 | 11/2017 | Federspiel | |
| 9,869,485 | B2 | 1/2018 | Ushirosako et al. | |
| 10,002,184 | B2 * | 6/2018 | Matsuoka | G06N 3/084 |
| 10,641,508 | B2 * | 5/2020 | Notaro | F24F 11/62 |
| 10,909,153 | B2 * | 2/2021 | Matsuoka | G05B 15/02 |
| 11,359,950 | B2 | 6/2022 | Noboa et al. | |
| 11,435,099 | B2 * | 9/2022 | Notaro | F24F 11/58 |
| 11,680,723 | B2 * | 6/2023 | Notaro | F24F 11/30 700/278 |
| 11,686,488 | B2 * | 6/2023 | Notaro | F24F 11/62 700/278 |
| 11,686,494 | B2 * | 6/2023 | Notaro | F24F 11/62 700/278 |
| 11,686,495 | B2 * | 6/2023 | Notaro | F24F 11/64 700/278 |
| 2007/0267508 | A1 * | 11/2007 | Hoglund | F24F 11/62 236/49.1 |
| 2010/0198411 | A1 * | 8/2010 | Wolfson | G05B 15/02 700/275 |
| 2011/0257795 | A1 * | 10/2011 | Narayanamurthy | F24F 5/0046 700/277 |
| 2012/0210736 | A1 * | 8/2012 | Rockenfeller | F25B 7/00 62/115 |
| 2012/0216555 | A1 * | 8/2012 | Ishii | F24F 11/86 62/126 |
| 2012/0248208 | A1 * | 10/2012 | Deligiannis | G05D 23/1902 236/51 |
| 2014/0316584 | A1 * | 10/2014 | Matsuoka | G05B 15/02 700/278 |
| 2014/0317029 | A1 * | 10/2014 | Matsuoka | G05D 23/1919 706/12 |
| 2014/0358294 | A1 * | 12/2014 | Nichols | F24F 11/64 700/278 |
| 2015/0032264 | A1 * | 1/2015 | Emmons | F24F 11/0001 700/276 |
| 2015/0105917 | A1 * | 4/2015 | Sasaki | F24F 11/523 700/276 |
| 2015/0108230 | A1 * | 4/2015 | Cloonan | F24H 15/265 165/209 |
| 2015/0276238 | A1 * | 10/2015 | Matsuoka | H04L 12/2816 700/278 |
| 2015/0330652 | A1 * | 11/2015 | Kim | F24F 11/30 700/276 |
| 2016/0252266 | A1 * | 9/2016 | Ushirosako | F24F 11/62 700/278 |
| 2017/0076263 | A1 * | 3/2017 | Bentz | G06V 40/10 |
| 2017/0102723 | A1 * | 4/2017 | Smith | H04L 12/6418 |
| 2017/0138612 | A1 * | 5/2017 | Kaiser | F24F 11/30 |
| 2017/0167744 | A1 * | 6/2017 | Arensmeier | F24F 11/30 |
| 2017/0211830 | A1 * | 7/2017 | Kosaka | F24F 11/64 |
| 2017/0268797 | A1 * | 9/2017 | Mowris | F24H 9/2064 |
| 2019/0103890 | A1 * | 4/2019 | Anthony | H03F 3/24 |
| 2021/0123622 | A1 | 4/2021 | Notaro et al. | |
| 2021/0180824 | A1 * | 6/2021 | Castillo | F24F 11/62 |

FOREIGN PATENT DOCUMENTS

| | | | |
|---|---|---|---|
| KR | 1020050074695 | A | 7/2005 |
| KR | 10-2015-0026208 | A | 3/2015 |

OTHER PUBLICATIONS

International Search Report and Written Opinion issued in related PCT Application No. PCT/US2021/065721 mailed Apr. 27, 2022, 12 pages.

"59MN7A—Modulating 4-Way Multipoise Gas Furnace—Series 100; Installation, Start-Up, Operating and Service and Maintenance Instructions", Carrier Corp., Oct. 2011, 84 pages.

* cited by examiner

SYSTEMS AND METHODS FOR AIR TEMPERATURE CONTROL USING A TARGET TIME BASED CONTROL PLAN

CROSS REFERENCE TO RELATED APPLICATION

This application is a divisional application of U.S. application Ser. No. 17/139,153, entitled "SYSTEMS AND METHODS FOR AIR TEMPERATURE CONTROL USING A TARGET TIME BASED CONTROL PLAN", filed on Dec. 31, 2020, now U.S. Pat. No. 11,686,494, issued on Jun. 27, 2023, which is a continuation application of U.S. application Ser. No. 16/832,618, entitled "SYSTEMS AND METHODS FOR AIR TEMPERATURE CONTROL USING A TARGET TIME BASED CONTROL PLAN", filed on Mar. 27, 2020, now U.S. Pat. No. 11,435,099, issued Sep. 6, 2022, which is a divisional application of U.S. application Ser. No. 15/043,134 entitled "SYSTEMS AND METHODS FOR AIR TEMPERATURE CONTROL USING A TARGET TIME BASED CONTROL PLAN," filed Feb. 12, 2016, now U.S. Pat. No. 10,641,508, which are herein incorporated by reference in their entirety.

TECHNICAL FIELD

The present invention relates to a heating ventilation and air-conditioning (HVAC) system, and more particularly to an HVAC system in which HVAC equipment is operated using a controller independent of a thermostat. The present inventions further relates to methods for operating such a controller.

BACKGROUND

Communicating thermostats and communicating HVAC equipment generally refer to HVAC equipment that exchange information and control signals using modern communications protocols. The increased flexibility of communicating systems provides several advantages. For example, communicating equipment may be automatically identified, including identification of available capacity settings and/or the number of stages for the equipment. A communicating thermostat may then use this information and the flexibility of the communications protocol to issue control signals corresponding to specific capacity settings to the equipment. Although the use of such protocols provides increased flexibility in the type and amount of data possible to be exchanged between communicating thermostats and communicating HVAC equipment, there are significant tradeoffs. First, communicating thermostats and HVAC equipment are generally more expensive than their non-communicating counterparts, making communicating systems cost prohibitive for many consumers. Second, communicating systems are generally inoperable with non-communicating equipment, older equipment, and equipment from different manufacturers. As a result, consumer choice is extremely limited regarding equipment to be used in a communicating system. Moreover, this lack of interoperability limits the ability of a consumer to retrofit or upgrade a system without a relatively complete replacement. Finally, while many of the features and capabilities of communicating systems make installation and setup much easier, many of these features have limited use for the end user.

In contrast, legacy thermostats and HVAC equipment generally rely on simpler control signals, such as on/off-type signals (typically 24 VAC signals), for communication and control. As a result, interoperability is generally less of a concern in HVAC systems implementing only legacy equipment, and consumers are given more flexibility in installing equipment that better suit their specific needs and budget. As used herein, the term "legacy" refers to equipment that has the ability to connect with a thermostat that sends 24 VAC on/off signals.

In light of the above, there is a need for a system that provides the improved degree of control afforded by a communicating system while allowing a broad range of thermostats and other HVAC equipment to be used within the system. Preferably, the system would allow for both communicating and non-communicating legacy equipment and the device discovery and configuration processes would occur using several methods alone or in combination and may include reading or retrieving information provided by an installer, customer, or other user; reading or retrieving information available in a remote database; reading or retrieving information directly from the HVAC equipment; or learning the properties of the HVAC equipment using a trial and error approach.

SUMMARY

Examples of systems and methods are provided for control of the air temperature of a building. For instance, examples of systems and methods are provided for operating a HVAC system according to a control plan based on a target time. The control plan may be designed to reach a desired air temperature in a building in the target time.

The system may include a controller that is coupled to indoor and/or outdoor HVAC units. The controller may include equipment terminals for controlling either communicating or non-communicating HVAC units. The controller may be communicatively coupled to a thermostat. The controller may also include sensor terminals which may be communicatively coupled to one or more air temperature sensors. The controller may also include accessory terminals for connecting devices such as indoor air quality equipment and dampers and other zoning equipment.

The controller may include a communication module. The communication module may be communicatively coupled with a computer device using a wired or wireless connection. The communication module may be used to send or receive performance and operation data relating to the HVAC system. The computer device may use the performance and operation data to analyze the HVAC system, providing for maintenance and optimized performance. The computer device may also be used to input control plan parameters such as target time and desired temperature.

The method for controlling the air temperature of a building may include discovering connected devices. The method may further include determining a target time and an initial control plan. The control plan may include operating one or more HVAC units at a variety of capacity or stage settings to achieve high performance or efficiency ratings. The control plan may then be executed by a controller in response to a heating/cooling call. The controller may then determine a satisfy time based on how long it takes to satisfy the heating/cooling call using the control plan. The actual satisfy time may then be compared with the target time and used to update the control plan. The method may then be repeated using the updated control plan when a new heating/cooling call is received.

These and various other features and advantages will be apparent from a reading of the following detailed description and drawings along with the appended claims. While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DESCRIPTION

Figure 1:
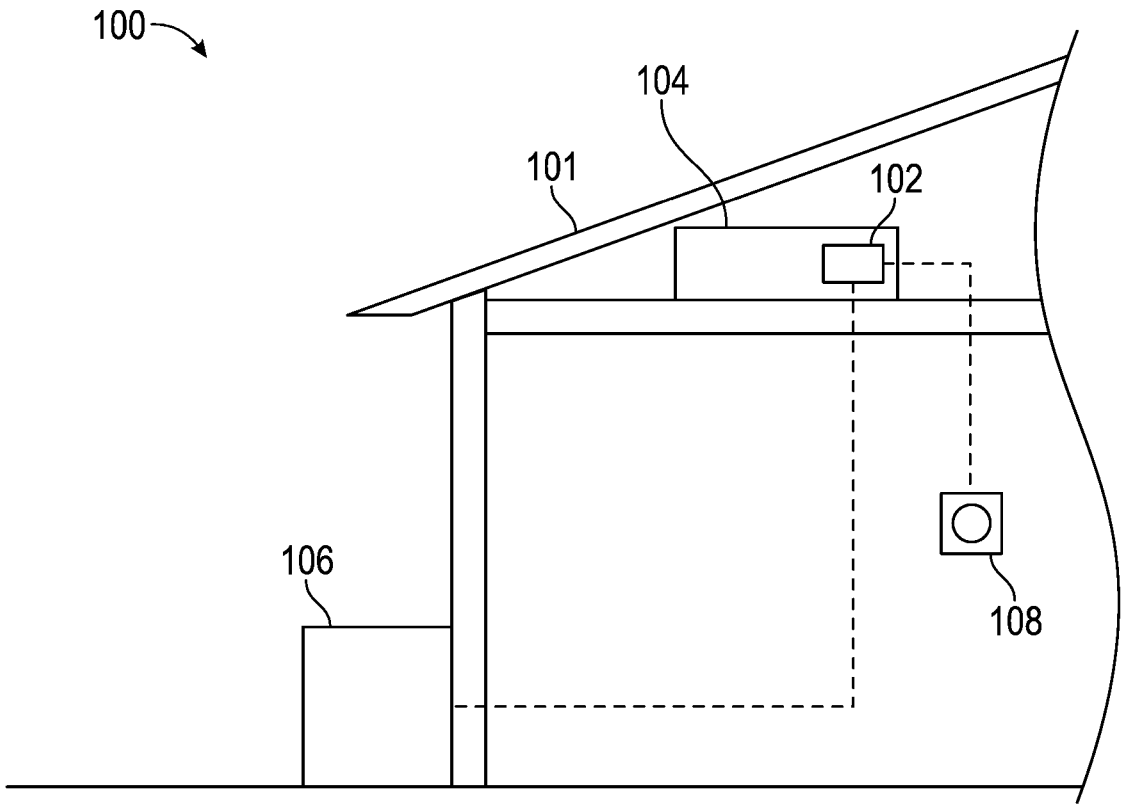
FIG. 1 shows an HVAC system incorporating an existing thermostat, according to some embodiments.

This disclosure generally relates to a system for controlling a heating ventilation and air-conditioning (HVAC) system and methods of controlling HVAC equipment in the HVAC system.

For purposes of this disclosure, an HVAC system refers to any system that provides one or more of heating, cooling, or ventilation to an environment, such as a building. The building can be, but is not limited to, a residential building such as a home, apartment, condominium, or similar. An HVAC system may include one or more pieces of HVAC equipment for providing heating, cooling, or ventilation. HVAC equipment includes, but is not limited to, furnaces, air-conditioners, heat pumps, blowers, air handlers, and dehumidifiers. HVAC equipment may be operable at one stage of operation only (i.e., single stage), at one of multiple discrete stages of operation (i.e., multi stage), or along a continuum of operational points, such as with modulating furnaces or inverter air-conditioning units. HVAC equipment may also operate using gas, electricity, or any other suitable source of energy.

The present disclosure is directed to an HVAC system comprising a controller. In certain embodiments, the controller is incorporated into one or more component of the HVAC system, such as a thermostat or piece of HVAC equipment, and communicatively coupled to other HVAC system components. In other embodiments, the controller is a standalone unit communicatively coupled to HVAC system components.

The controller operates by attempting to satisfy heating or cooling calls received by the controller within a specified target time. To do so, the controller determines an initial control plan for satisfying the heating/cooling call at a target time and then proceeds to operate the HVAC system based on the initial control plan. The controller then compares the actual time taken to satisfy the heating/cooling call to the target time and adjusts the control plan accordingly. The new control plan may then be implemented in the subsequent heating/cooling cycle. Based on the results of comparing the actual satisfy time to the target time in the subsequent cycle, the control plan may again be adjusted. This process may repeat continuously, gradually converging on a control plan that satisfies the heating/cooling plan in as close to the target time as possible.

The control plan comprises settings at which HVAC equipment is to be run in order to satisfy the heating/cooling call. The control plan may comprise instructions corresponding to one or more of what equipment is to be run, how long a piece of equipment is to be run, and, if the equipment is capable of being run at more than one stage or capacity, the particular stage or capacity the equipment is to be run. For example, if an HVAC system includes a three-stage air-conditioning and is required to satisfy a cooling call within a 20 minute target time, the control plan may comprise instructions to operate the air conditioner at the second stage for 15 minutes and the first stage for 5 minutes.

In certain embodiments, the control plan may be adjusted if the actual satisfy time is greater than or less than the target time. For example, if the actual satisfy time is greater than the target time, the current parameters of the control plan are generally inadequate to provide sufficient heating or cooling. Accordingly, the controller may change the operating equipment, timing, or capacity parameters of the control plan to provide more heating or cooling as necessary. Conversely, if the actual satisfy time is less than the target time, it may be assumed that the current parameters of the control plan are too aggressive. As a result, the controller may change the operating equipment, timing, or capacity parameters of the control plan to provide less heating or cooling.

The present disclosure is now described in detail with reference to one or more embodiments thereof as illustrated in the accompanying drawings. In the following description, numerous specific details are set forth in order to provide a thorough understanding of the present disclosure. However, the present disclosure may be practiced without some or all of these specific details. In other instances, well known process steps and/or structures have not been described in detail in order not to unnecessarily obscure the present disclosure. In addition, while the disclosure is described in conjunction with the particular embodiments, it should be understood that this description is not intended to limit the disclosure to the described embodiments. To the contrary, the description is intended to cover alternatives, modifications, and equivalents as may be included within the spirit and scope of the disclosure as defined by the appended claims.

FIG. 1 is a schematic depiction of an HVAC system 100 in accordance with an embodiment of this disclosure. As depicted, HVAC system 100 is incorporated into a building 101. The HVAC system 100 includes a controller 102. Controller 102 is depicted as being incorporated into and communicatively coupled with an indoor unit 104. Indoor unit 104 may comprise, but is not limited to, heating equipment such as a furnace. Controller 102 is also communicatively coupled to an outdoor unit 106, which may comprise, but is not limited to, cooling equipment such as an air conditioner. Other examples of indoor and outdoor units include but are not limited to air handlers and heat pumps, respectively. Controller 102 is further communicatively coupled to a thermostat 108.

During operation, controller 102 receives heating or cooling calls from thermostat 108. Specifically, sensors within thermostat 108 determine if the current temperature within building 101 rises above (in the case of cooling) or falls below (in the case of heating) a temperature set point. If one of these events occurs, thermostat 108 issues a heating or cooling call to controller 102. In response, controller 102 may issue control signals to one or more pieces of HVAC equipment, including indoor unit 104 and outdoor unit 106.

Figure 2:
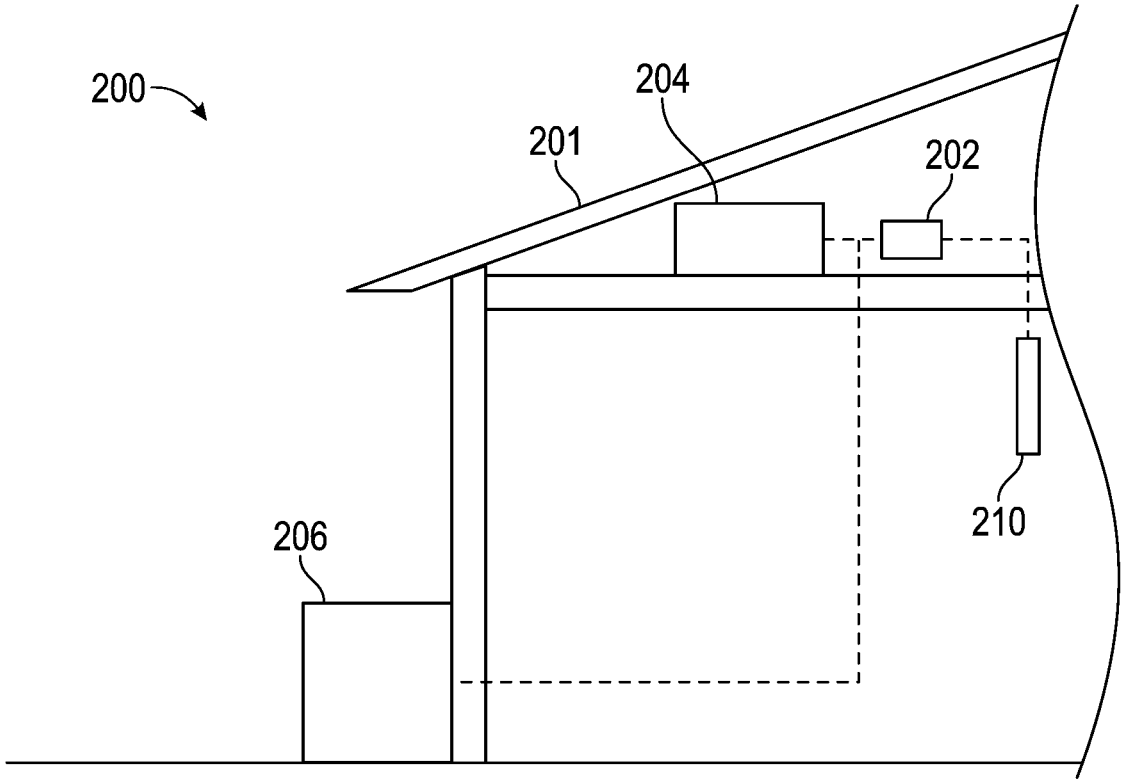
FIG. 2 shows an HVAC system operating without a thermostat, according to some embodiments.

In the embodiment of FIG. 1, thermostat 108 performs several functions. First, thermostat 108 senses the temperature within building 101. Second, in response to the temperature within building 101 being above or below a desired set point, thermostat 108 provides a signal to controller 102 calling for cooling or heating, respectively. Once the desired temperature is reached, the heating/cooling call is removed. In certain embodiments, one or more of these functions may be performed by the thermostat or by other components of the HVAC system. Thermostat 108 may also provide signals to enable or disable other optional equipment including, but not limited to, humidifiers and ventilators (not shown). In the embodiment of FIG. 2, for example, a thermostat is not required and the functions described are instead performed by a temperature sensor alone or in combination with a controller.

FIG. 2 is a schematic depiction of a second embodiment of an HVAC system 200 in accordance with this disclosure. HVAC system 200, which is incorporated into building 201, includes an indoor unit 204 and an outdoor unit 206 communicatively coupled to a controller 202. Indoor unit 204 may comprise, but is not limited to, heating equipment such as a furnace. Outdoor unit 206 may comprise, but is not limited to, cooling equipment such as an air conditioner. Other examples of indoor and outdoor units include, but are not limited to, air handlers and heat pumps, respectively. In contrast to the embodiment of FIG. 1 in which controller 102 was incorporated into indoor unit 104, controller 202 is depicted as a standalone unit.

The embodiment of FIG. 2 further includes a temperature sensor 210 for determining the temperature within building 201. In certain embodiments, temperature sensor 210 may be configured to determine one or more of the actual temperature within building 201 or whether the current temperature within building 201 is above or below a temperature set point.

Temperature-based signals and data from temperature sensor 210 may be received and analyzed by controller 202. For example, controller 202 may generate control signals to control HVAC equipment such as indoor unit 204 and outdoor unit 206, based at least in part on the temperature-based signals received from temperature sensor 210. In certain embodiments, sensor 210 may transmit the temperature readings to controller 202. Controller 202 may monitor the temperature readings provided by sensor 210 to determine if the temperature in building 201 exceeds or falls below a temperature set point, thereby causing the controller 202 to generate a heating/cooling call. In response to the heating/cooling call, controller 202 may issue appropriate control signals to at least one of the indoor unit 204 and the outdoor unit 206. In other embodiments, sensor 210 may transmit a signal that the building 201 air temperature is above or below a temperature set point. Controller 202 may then generate a heating/cooling call and issue control signals to control HVAC equipment such as indoor unit 204 and outdoor unit 206 in response to this signal. In certain embodiments, temperature readings from temperature sensor 210 may also be stored in a memory module of the controller 202. Stored temperature readings may be used by the controller 202 to determine temperature trends, response times to control signals, and other metrics to be used in refining a control plan implemented by the controller 202.

Figure 3:
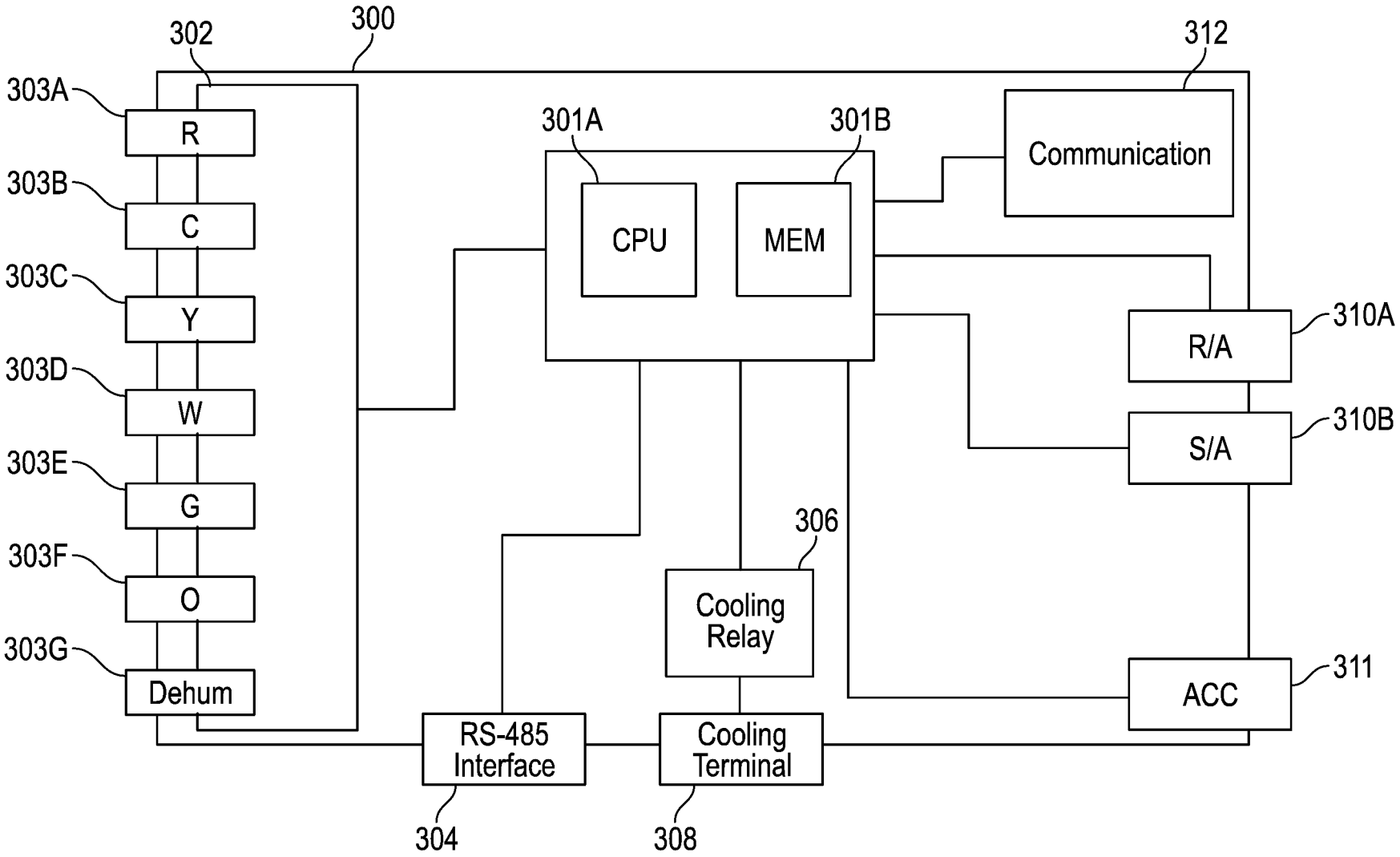
FIG. 3 is an illustrative embodiment of a controller for use in an HVAC system.

FIG. 3 is a schematic depiction of controller 300 according to an embodiment of this disclosure in which controller 300 is configured to receive signals from a legacy thermostat. As previously noted, controller 300 may be incorporated into an indoor unit, an outdoor unit, or a thermostat or may be part of a standalone component. Controller 300 may include a processing unit 301A and memory module 301B.

Because controller 300 is intended for use with a legacy thermostat, controller 300 includes a terminal block 302 to connect controller 300 to a legacy thermostat. Terminal block 302 may include terminals corresponding to one or more corresponding output terminals of the legacy thermostat. For example, as shown in FIG. 3, terminal block 302 includes a 24 VAC supply line terminal (R) 303A, a common ground terminal (C) 303B, a cooling call terminal (Y) 303C, a heating call terminal (W) 303D, a fan terminal (G) 303E, a reversing valve terminal (0) 303F, and a dehumidifier terminal (Dehum) 303G. In other embodiments, one or more of terminals 303A-G may be omitted or other terminals may be added. For example, if a thermostat is capable of issuing control signals corresponding to multiple stages of heating or cooling calls (e.g., Y2 or W2 terminals), the controller may include corresponding terminals for receiving such signals.

Controller 300 may also include one or more equipment terminals for communicating with indoor and/or outdoor units. For example, controller 300 may include a RS-485 interface 304 suitable for communicating data and control signals to communicating HVAC equipment. Controller 300 may also include components for controlling non-communicating equipment using other signals, such as 24 VAC signals. For example, controller 300 includes a cooling relay 306 and a corresponding cooling terminal block 308 for connecting controller 300 to a non-communicating air-conditioning unit.

Controller 300 may also include interfaces for receiving data or signals from other components of the HVAC system. For example, controller 300 includes sensor interfaces 310A, 310B for receiving data from a return air (R/A) and a supply air (S/A) sensor, respectively. Controller 300 may also include an accessory interface 311 for communicatively coupling other components of the HVAC system, including, but not limited to, indoor air quality equipment, dehumidifiers, humidifiers, ventilators dampers, and other zoning equipment.

Controller 300 may also include a communication module 312 for communicating with a computing device. Communication module 312 may include a wired interface. For example, in certain embodiments, communication module 312 may include, but is not limited to, one or more of a universal serial bus, Ethernet, FireWire, Thunderbolt, RS-232, or similar interface. Instead of or in addition to a wired interface, communication module 312 may include a wireless interface for communicating with a computing device. Such wireless interfaces may include, but are not limited to, Bluetooth, Wi-Fi, and ZigBee interfaces. In certain embodiments, communication module 312 may be configured to connect controller 300 directly to the computing device. Communication module 312 may also be configured to connect controller 300 to the computing device over a computer network, including, but not limited to, a local area network (LAN), a wide area network (WAN) and the internet.

Communication module 312 generally permits controller 300 to exchange data with the computing device. In certain embodiments, the data exchanged between the controller 300 and the computing device may include system configuration data. System configuration data may include data regarding the HVAC system in which controller 300 is installed, including information regarding any HVAC equipment or components that are included in the HVAC system. Configuration data may include general information about the basic types of equipment included in an HVAC system, but may also include specific details regarding particular pieces of HVAC equipment. For example, if an HVAC system includes a multi-stage air conditioner, the configuration data may include product details including the brand, model, product number, and serial number of the unit. The configuration data may also include performance details including the number of stages and corresponding capacities of the air conditioner.

Communication module 312 may also be configured to send and/or receive operating parameters. As previously discussed, controller 300 generally operates by developing and executing a control plan to meet heating and cooling calls to reach a desired temperature set point in as close to a target time as possible. During operation, communication module 312 may be used to send or receive operating parameters such as the temperature set point and target time to set or retrieve the operational goals of the HVAC system.

Communication module 312 may also be used to exchange historical performance data with a computing device. For example, controller 300 may store temperature readings received from a temperature sensor of the HVAC system in memory module 301B and transmit or otherwise make the temperature data available to a computing device. Controller 300 may also transmit historical performance data that may be used to assess the general effectiveness of the system and to determine whether maintenance may be required. For example, the controller may provide data regarding the amount of time which a particular piece of HVAC equipment is operated. Such usage information may then be used to determine the likely life of HVAC equipment parts and to develop a corresponding maintenance schedule.

Figure 4:
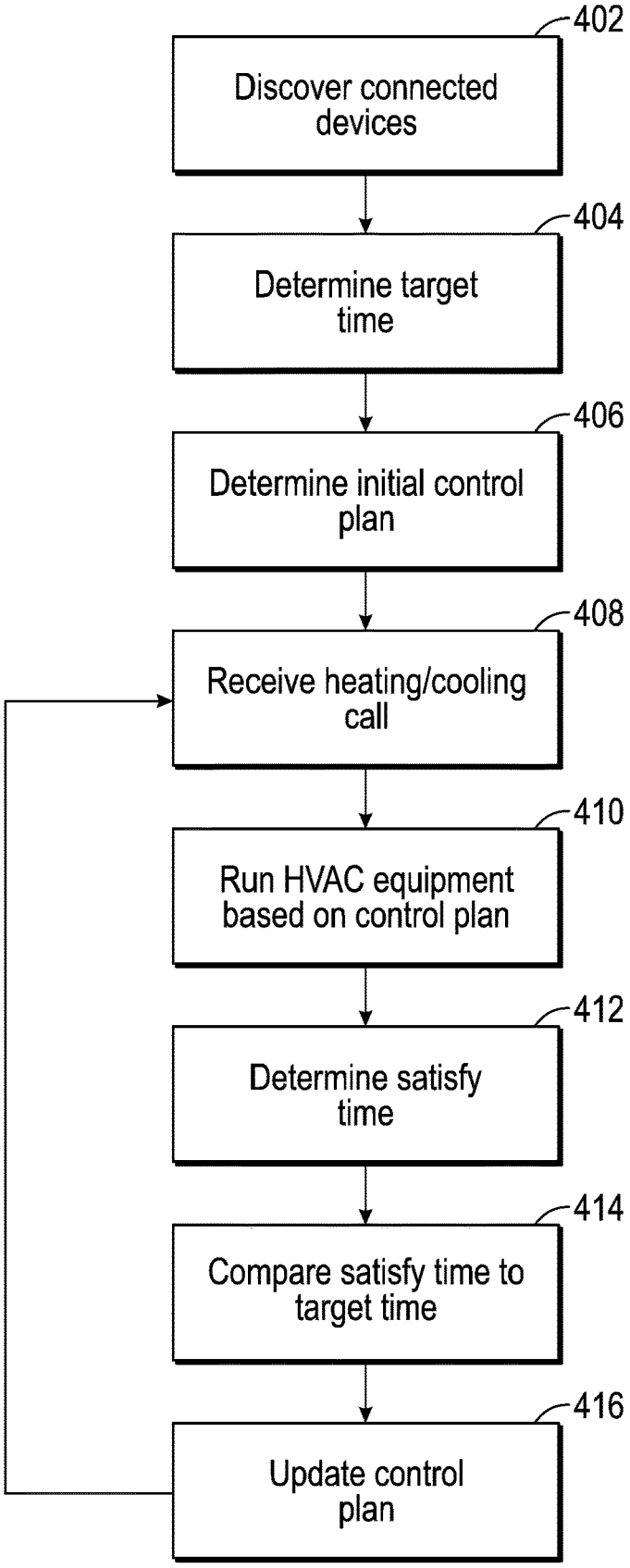
FIG. 4 is a flow chart illustrating an embodiment of a method for controlling the air temperature of a building using a control plan based on a target time.

FIG. 4 is a flow chart illustrating an embodiment of a general method for operating an HVAC system in accordance with this disclosure. In one or more embodiments, any one or more of the steps described may not be performed. In other embodiments, any one or more of the steps depicted may be performed in any suitable order or in any combination.

The method begins at step 402 with the controller initiating device discovery. Device discovery generally refers to the process of identifying the equipment present in an HVAC system and may include determining one or more of the type, capacity, number of stages, or other characteristics of that equipment.

Device discovery may occur using several methods alone or in combination and may include reading or retrieving information provided by an installer, customer, or other user. For example, in certain embodiments, the user may configure a series of dip switches located at a controller, a thermostat, a piece of HVAC equipment, or any other suitable location within the HVAC system to indicate the characteristics of one or more pieces of HVAC equipment within the system. During device discovery, a controller or other suitable piece of equipment in the system may read the dip switches to determine the characteristics of installed HVAC equipment.

In certain embodiments, device discovery data may be stored in and retrieved from memory. For example, device discovery data may be stored locally in the memory of a controller of the HVAC system. In other embodiments, the device discovery data may be stored in a remote location, for example in a remote server. In either embodiment, the device discovery process may comprise executing instructions to retrieve the device discovery data from the memory, regardless of where the memory is located.

The device discovery data may be stored in memory that is read-only memory. For example, the memory may include device discovery data that is fixed during manufacturing of the HVAC system. In certain embodiments, the read-only memory may store default information corresponding to a default HVAC system and may permit an installer or other user to reset the HVAC system to the default HVAC system if an error, system failure, or other problem is encountered.

In certain embodiments, the memory may be reprogrammable by a user. In such embodiments, the user may be able to input information corresponding to the HVAC system to be stored in memory. Any suitable method may be used to program the memory. For example, the user may use a software application to configure the HVAC system and input device data. Such software may be run on any suitable platform. For example, in certain embodiments, device data may be input using a panel or terminal specifically designed for the HVAC system. In other embodiments, a user may use a computing device having a program or application installed that allows the user to input or modify device data. Such general computing devices may include, but are not limited to, laptops, notebook computers, tablets, smartphones, netbooks, and desktop computers. Inputting of device data may be done by directly connecting the computing device to the HVAC system using any suitable interface or by remotely providing the device data, including by providing data over a wired or wireless connection. For example, in certain embodiments, a user may input device data by directly connecting a computing device to a piece of equipment in the HVAC system using a wired connection which may include, but is not limited to, one or more of a universal serial bus, Ethernet, FireWire, Thunderbolt, RS-232, or similar interface. In other embodiments, the user may provide device data to the HVAC over the internet or through any suitable wireless technology, including but not limited to Wi-Fi, Bluetooth, and ZigBee.

In certain embodiments, device data may be stored and retrieved from a database. The database may be stored locally in memory connected to the HVAC system or may be remotely accessible from a server or other remote data source. In certain embodiments, device data corresponding to a given piece of HVAC system may be retrieved from the database based on information provided by a user or by components of the HVAC system.

For example, in certain embodiments, information may be provided to a database regarding a particular piece of HVAC equipment to include in an HVAC system. Based on the information, one or more database entries may be returned. For example, if a product name or product ID corresponding to a particular piece of HVAC equipment is provided, device data for the particular product may be returned. Alternatively, if more generic information (e.g., heating or cooling, number of stages, capacity, etc.) is provided, multiple entries may be returned from which a selection or further refinement of the retrieved entries may be made.

Device data may also be reported to the HVAC system by the connected equipment. In certain embodiments, a piece of HVAC equipment may automatically report its device data to the HVAC system when first connected to the HVAC system. The HVAC equipment may also provide its device data in response to a device data request received from other components of the HVAC system.

In certain embodiments, device characteristics may also be determined using a trial and error approach. For example, if a cooling command is issued and temperature does not drop, the attached equipment is likely a furnace or other heating equipment. A similar approach may be used to determine if a piece of HVAC equipment is capable of operating at multiple capacities or stages. For example, after determining that a cooling unit is connected, a cooling command may be issued, requesting the HVAC equipment to provide cooling at a first stage and a second stage corresponding to different capacities. If cooling following issuance occurs faster when operating in one stage or the other, the connected HVAC unit is likely a two-stage unit. Conversely, if no change is observed or if cooling does not occur, then the HVAC unit is likely a single-stage unit.

After discovery has occurred, the controller determines the desired target time 404. Target time may be input directly by a user or installer or may be determined automatically based on user preferences. For example, a user may indicate a preference that the system operates to maximize performance, maximize user comfort, maximize efficiency, or to achieve a preferred balance of performance, comfort, and efficiency. In response, the controller may automatically determine an appropriate target time corresponding to the preferences. For example, if a user prefers performance over efficiency, the controller may apply a short target time such that the HVAC equipment is operated at a relatively high capacity for a shorter period of time. On the other hand, if a user prefers efficiency over performance, the controller may select a longer target time such that the HVAC equipment is operated at a lower capacity for a longer time.

In certain embodiments, the user may input the desired target temperature directly into a thermostat that is communicatively coupled to the HVAC system controller. In other embodiments, the HVAC system controller may have a means for directly inputting the desired target temperature. In still other embodiments, the user may input the desired target temperature by directly connecting a computing device to the HVAC system using any suitable interface or by remotely providing the device data, including by providing data over a wired or wireless connection. Such general computing devices may include, but are not limited to, laptops, notebook computers, tablets, smartphones, netbooks, and desktop computers. A suitable wired connection may include, but is not limited to, one or more of a universal serial bus, Ethernet, FireWire, Thunderbolt, RS-232, or similar interface. A suitable wireless may include, but is not limited to Wi-Fi, Bluetooth, and ZigBee.

Once a target time has been determined, the controller develops an initial control plan 406 for operating the HVAC equipment to satisfy a heating/cooling call in as close as possible to the target time. Establishing the initial control plan may occur in various ways and may differ depending on whether the equipment to be controlled is staged, and therefore has discrete capacity levels, or modulating, and is therefore capable of a continuous range of capacities.

In certain embodiments in which staged equipment is to be controlled, the initial control plan may be established by determining satisfy times for each of one or more stages. A satisfy time is generally the time required for HVAC equipment operating at a particular stage or capacity to satisfy a heating/cooling call. Based on the satisfy times, the controller may then determine at which stage or stages one or more pieces of HVAC equipment should be operated and approximate the time required to run at each stage(s) in order to satisfy a subsequent heating/cooling call in a time that is as close as possible to the target time.

In certain embodiments, the actual satisfy time for any given stage or capacity setting may be determined by running the equipment at the stage until the heating/cooling call is satisfied. This approach may be repeated for each stage of the HVAC equipment to determine the full range of satisfy times.

In certain embodiments, determining satisfy times may comprise determining the satisfy time for a subset of stages and then calculating, estimating, looking up or otherwise determining satisfy times for any remaining stages based on the satisfy times of the subset of stages. For example, the satisfy time for the maximum capacity of a piece of HVAC equipment may be determined as previously described. Once the maximum capacity satisfy time has been determined, the satisfy times of any remaining stages or capacity settings may be calculated, estimated, looked up, or otherwise determined based on the maximum capacity satisfy time. Doing so eliminates the need to run the HVAC equipment at each stage or capacity setting to establish the satisfy times.

In certain embodiments in which satisfy times are determined from a subset of satisfy times, a proportional capacity map may be applied to the known satisfy times in order to determine satisfy times for any remaining stages or capacity settings. One such method of doing so is to apply a proportional capacity map that determines satisfy times based on the relative capacities of stages to the capacities of stages for which an actual satisfy time has been determined. For example, a system having a first, second, and third stage corresponding to 40%, 60% and 100% (i.e., maximum) capacity may first be run at maximum capacity and a corresponding maximum capacity satisfy time of 10 minutes may be achieved. Applying a proportional capacity map based on capacity may then result in estimates for the first and second stage satisfy times of 25 minutes and 17 minutes, respectively.

More sophisticated mappings may also be implemented. For example, instead of, or in addition to, the ratios of stage capacities, the capacity map may be based on a model that takes into account thermodynamic effects, equipment characteristics, room characteristics, or any other factor that may affect the time in which a given piece of HVAC equipment is able to satisfy a heating/cooling call. In certain embodiments, the capacity map may be created based in whole or in part on empirical data, which may include data generated during testing of the HVAC equipment or similar units or data collected during actual operation once installed.

Because a low stage may not be able to satisfy the heating/cooling call within a reasonable time, or at all, certain embodiments may include a timeout if a heating/cooling call is not satisfied within a given time. In embodiments implementing a timeout, the process of determining the initial control plan may be abbreviated by not determining the satisfy times for any stages with capacities below that of a timed out stage.

Based on the satisfy times, the controller may establish an initial control plan comprising instructions for the HVAC system including, but not limited to, what equipment to operate, at what capacity the equipment should be operated, and for how long. As a result, the initial control plan is a best guess of how to operate the HVAC equipment in order to satisfy a heating/cooling call in as close to the target time as possible.

In one embodiment, the initial control plan is established by first determining the minimum stage capable of satisfying the heating/cooling call in less than the target time. Because the minimum satisfying stage will not properly satisfy the heating/cooling call in the target time, the target time may be more closely achieved by running the HVAC equipment at the minimum satisfy time for a first period of time then switching the HVAC equipment to the next higher stage for a second period of time. The length of the first and second periods of time may be based off of the satisfy times of the two stages. For example, if a target time is 10 minutes, a third stage satisfies in 6 minutes, a second stage satisfies in 8 minutes, and a first stage satisfies in 16 minutes, the second stage is the minimum satisfying stage. Accordingly, the second stage and the first stage are used in the initial control plan. Based on these specific numbers, the initial timing would be to operate at the first stage for 2.5 minutes and the second stage for 7.5 minutes.

After the initial control plan is determined, the controller receives a heating/cooling call at 408. In certain embodiments, the heating/cooling call may be received from a legacy thermostat communicatively coupled with the controller. In other embodiments, the heating/cooling call may be received from a communicating thermostat coupled with the controller. In other embodiments, the heating/cooling call may be generated by the controller itself in response to a temperature signal received by the controller from a communicatively coupled air temperature sensor. In response to the heating/cooling call, the controller runs the HVAC equipment based on the current control plan until the heating/cooling call is satisfied. In certain embodiments, the controller may be programmed to time out if the heating/cooling call is not satisfied within a particular time period. Doing so may avoid situations in which the initial control plan underserves a heating/cooling call such that the heating/cooling call cannot be satisfied in a reasonable time, or at all.

Once the heating/cooling call is satisfied, the controller determines the actual satisfy time using the current control plan at 412. The controller then compares the actual satisfy time to the target time at 414. Based on whether the actual satisfy time is greater than or less than the target time and, in certain embodiments, by what degree the target time and satisfy time differ, the controller updates the control plan at 416. When the controller receives a subsequent heating/cooling call, the controller implements the updated control plan, determines the satisfy time based on the updated control plan, compares the satisfy time under the updated control plan to the target time and updates the control plan again to account for any differences. This process may repeat continuously with the controller updating the control plan after every heating/cooling cycle.

As previously mentioned, the control plan may be updated based on whether the heating/cooling call was satisfied in more or less than the target time and, in certain embodiments, the degree to which the target time was missed. If the heating/cooling call is satisfied in more than the target time, the control plan is adjusted to provide additional heating/cooling accordingly. To do so, the controller may adjust the control plan in various ways, including by changing one or more of the HVAC equipment used in the control plan, the stages or capacities at which a piece of HVAC equipment is run, and the time during which a piece of HVAC equipment is run.

As an example, an embodiment of the current disclosure may include a controller communicatively coupled to a two-stage air-conditioner that implements a control plan comprising running the air-conditioner at the first stage for a first period of time and at the second stage for a second period of time. After implementing the control plan, the controller may determine that the time required to satisfy a cooling call is greater than or less than the target time. In response, the controller may adjust the first and second time periods to account for any discrepancies between the actual satisfy time and the target time. For example, if the cooling call was not satisfied within the target time, the control plan may be adjusted to increase the amount of time during which the air-conditioner is run at the second stage.

To the extent the controller is configured to adjust timing, the times for which pieces of HVAC equipment are operated or the times at which HVAC equipment is operated at particular stages or capacities may be adjusted by a fixed amount. For example, the timing may be adjusted by a set number of seconds in favor of the lower stage if the heating/cooling call is satisfied too quickly or the same number of seconds in favor of the higher stage if the heating/cooling call is not satisfied within the target time.

In other embodiments, timing adjustments may be variable. For example, one or more equations may be used to calculate new timing after each heating/cooling cycle. Such equations may adjust the timing based on the degree to which the satisfy time for the more recently completed cycle differs from the target time. An example of such an equation is as follows:

$$\text{New Low Stage Time} = \text{Current Low Stage Time} \times \left(\frac{\text{Target Time}}{\text{Satisfy Time}}\right) \times C.F.$$

As shown in the equation, the new run time for the low stage is based on the current timing of the low stage and the ratio of the target time to the actual satisfy time for the current cycle. An optional correction factor (C.F.) may also be included in the equation to account for non-linearity and other adjustments to the newly calculated timing.

In certain embodiments, the control plan may be adjusted by changing the capacity at which one or more pieces of HVAC equipment are operated. Adjusting the capacity may comprise changing the stage at which HVAC equipment is operated or, in the case of modulating HVAC equipment capable of operating along a continuum of capacities, changing the operating point of the modulating HVAC equipment. Capacity adjustments may be made in addition to or instead of timing adjustments.

In certain embodiments in which the control plan is adjusted by changing capacities, determining the initial control plan 406 may comprise determining an initial capacity. The initial capacity may be the minimum capacity that will satisfy a heating/cooling call in as close to the target time as possible. Determining the initial capacity may be achieved in various ways. For example, in certain embodiments, the controller may complete multiple heating/cooling cycles at various capacities and determine the actual time required to satisfy the heating/cooling call at each capacity. The capacity with a satisfy time that deviates the least from the target time may then be chosen as the initial capacity.

In other embodiments, the HVAC equipment may be run at a test capacity and the initial capacity for the control plan may be estimated, calculated, or otherwise determined based on the satisfy time of the test capacity. For example, in certain embodiments, the test capacity may be the maximum capacity of the HVAC equipment. Accordingly, if a target time is 20 minutes and the heating/cooling call is satisfied in 15 minutes when operating at maximum capacity, the initial capacity for the control plan may be determined to be 75%.

After the initial capacity is determined, the controller may implement a control plan based on the initial capacity in response to a heating/cooling cycle. Once the heating/cooling call is satisfied, the satisfy time is compared to the target time and the control plan is adjusted. In general, if the satisfy time is less than the target time, the capacity parameters for the control plan are decreased. Conversely, if the satisfy time is more than the target time, the capacity parameters of the control plan are increased. In certain embodiments, this process repeats, continuously adjusting the capacity of the HVAC equipment to hone in on the target time.

In certain embodiments, adjustments to the capacity may occur in fixed increments. For example, the capacity may be adjusted by one of a fixed percentage of the HVAC equipment's total capacity, a fixed amount of volumetric output, and a fixed amount of energy output (e.g., watts or BTU/hr).

In other embodiments, capacity adjustments may be variable. For example, one or more equations may be used to calculate new capacity after every heating/cooling cycle. Such equations may adjust the capacity based on the degree to which the satisfy time of the most recently completed cycle differs from the target time. An example of such an equation is as follows:

$$\text{New Capacity} = \text{Current Capacity} \times \left(\frac{\text{Satisfy Time}}{\text{Target Time}}\right) \times C.F.$$

As shown in the equation, the new capacity for the subsequent cycle is based on the current capacity and the ratio of the target time to the actual satisfy time for the current cycle. An optional correction factor (C.F.) may also be included in the equation to account for non-linearity and other adjustments to the newly calculated timing.

Notification that a heating/cooling call has been satisfied may occur in various ways depending on the equipment in the system. For example, in systems with legacy thermostats, the notification may correspond to the removal of a cooling or heating request by the thermostat. In systems that include temperature sensors, the notification may be generated in response to a temperature sensor detecting that a temperature set point has been reached. In certain embodiments, the notification may be generated by the temperature sensor. In other embodiments, the controller may generate a notification internally based on temperature readings received from the temperature sensor or sensors. Alternatively, the sensor itself may generate a signal indicating that the temperature set point has been reached.

In certain embodiments, the HVAC system of the present disclosure is not limited to a single sensor. The system may include multiple sensors located throughout a building. In some embodiments, the sensors may be located in the rooms of the building. In still other embodiments, the sensors may be located in the ductwork of the HVAC system itself. It should also be understood that the sensors of the present disclosure are not limited to temperature sensors. The sensors may include, but are not limited to, temperature and humidity sensors. The HVAC system controller may incorporate all information received from these sensors, for example temperature and humidity readings, into the control plan. Furthermore, the information from any of these receivers may be sent to a computing device, as discussed above, for direct monitoring by a user or other system.

In certain embodiments, additional inputs or data, such as a temperature set points and real-time temperature readings, may be used to adjust timing or capacity settings of the control plan. Such data may be useful in determining the effectiveness of a particular control plan or in developing a more suitable control plan in fewer cycles than would be required without the additional data. For example, if a sensor provides real-time temperature data, a rate of temperature change associated with particular stages or capacities may be determined. The rate of change may then be used to correct or otherwise refine stage timing or capacity determinations.

In certain embodiments, the control plan does not require a satisfy time to operate. If the temperature of the building is provided to the controller, then the controller may design a control plan using an algorithm that does not require calculation of a satisfy time. In certain embodiments, the controller may determine an initial control plan based on the temperature inside the building, the HVAC equipment available, and the preferences of the user. The controller may then monitor the temperature inside the building and update the control plan based on the user's desired preferences of performance, comfort, and efficiency.

As previously discussed, the control plan is generally established by determining initial control plan parameters, which may include timing and/or capacity settings, and iteratively adjusting the control plan parameters to develop a control plan that satisfies a heating/cooling call in as close to a target time as possible. Because of the iterative process, a controller operating in a relatively steady-state environment and with a consistent target time and temperature set point will generally converge on a particular control plan. In other words, the degree of adjustments required for the timing and capacity settings will eventually diminish as more heating/cooling cycles are performed. However, the environment in which the HVAC system is operating and the operating parameters of the HVAC system may be changed during operation. For example, the environment being controlled by the HVAC system may be subject to changes in temperatures caused by, for example, the opening of a window or door, changes in exterior temperatures, or uses of heat-generating appliances. Operating parameters of the system, such as the desired temperature set point and/or the desired target time, may also be changed.

In general, the previously disclosed approach will adjust for such changes and will converge on a new control plan that accounts for the changed conditions provided that the HVAC equipment is capable of meeting the resulting heating/cooling calls. However, under certain circumstances, such as when changes are particularly sudden or drastic, it may be more efficient for the system to begin from a new initial control plan than to adjust the current control plan over the course of multiple heating/cooling cycles.

In certain embodiments, the control plan may recognize when an unexpected change in performance can be ignored. For example, if a control plan is repeatedly satisfying a cooling call based on a 20 minute target time, and an unexpected event, such as the opening of a door, causes the next cooling call to be satisfied in 10 minutes, then the control plan would recognize that this was not a permanent change to the cooling requirements of the building, and would not adjust the control plan accordingly.

Restarting the control process by determining a new initial control plan may be triggered by various conditions and events. In certain embodiments, for example, the controller may restart from a new initial control plan based on the degree to which the satisfy time or the most recent heating/cooling cycle differs from that of the second-to-last heating/cooling cycle. Large differences in satisfy times for consecutive heating/cooling cycles may indicate that a significant change has occurred in one or more of the controlled environment or the operating parameters. Accordingly, in response to discrepancies in satisfy times, the system may be configured to restart from a new initial control plan.

Restarting from a new initial control plan may also be triggered by a timeout event caused by the currently implemented control plan failing to satisfy a heating/cooling call within a particular time. The timeout may be based on an absolute time, such as a particular number of minutes. The timeout may also be based on a different parameter such as the target time. For example, a timeout may occur if the current control plan fails to satisfy a heating/cooling call within twice the target time.

Implementing a timeout may be particularly useful in multi-stage machines. For example, if a three-stage air-conditioner is operated using its first and second stages only, a sufficient inflow of heat may prevent the air conditioner from satisfying a corresponding cooling call within the target time even if the second stage were to run continuously. To avoid continuously running at the second stage, a timeout may be implemented to stop the current control plan and develop a new initial control plan, which may include operating the air-conditioner at the second and third stages. Alternatively, a timeout may cause the system to increment or decrement the currently operational stages of the equipment without requiring a new initial control plan.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A method for controlling air temperature in a building, comprising:

wirelessly receiving, via a controller, as user input a target air temperature and a target time; and operating, via the controller, one or more equipment of a heating ventilation and air-conditioning (HVAC) system to achieve the target air temperature in the target time, wherein the operating comprises:

operating the one or more equipment of the HVAC system according to an initial control plan;

determining an actual time taken for achieving the target air temperature;

determining a modified control plan when the actual time is not same as the target time; and operating the one or more equipment of the HVAC system according to the modified control plan.

2. The method of claim 1, further comprising:

repeating the steps of determining the actual time, determining the modified control plan and operating the one or more equipment of the HVAC system according to the modified control plan.

3. The method of claim 1, further comprising:

receiving a heating call or a cooling call from a thermostat; and operating the one or more equipment of the HVAC system to achieve the target air temperature in the target time, in response to receiving the heating call or the cooling call.

4. The method of claim 1, further comprising:

receiving measurements from a plurality of sensors located at multiple locations within the building, wherein each of the sensors is configured to measure at least one of the air temperature in the building or a humidity in the building; and determining at least one of the initial control plan or the modified control plan based on the measurements.

5. The method of claim 1, wherein:

the one or more equipment of the HVAC system comprises one or more communicating equipment of the HVAC system.

6. The method of claim 1, wherein:

the one or more equipment of the HVAC system comprises one or more non- communicating equipment of the HVAC system.

7. The method of claim 1, wherein the one or more equipment comprises at least one of one or more furnaces, one or more air conditioners, one or more air handlers or one or more heat pumps.

8. A method of controlling air temperature in a building, comprising:

wirelessly receiving using a wireless interface one or more configuration parameters from a mobile device;

storing the one or more configuration parameters in a memory; and controlling at least one equipment of an HVAC system associated with the building according to the one or more configuration parameters.

9. The method of claim 8, wherein:

the one or more configuration parameters comprises a target air temperature and a target time; and controlling the at least one equipment comprises operating the at least one equipment to achieve the target air temperature in the building in the target time.

10. The method of claim 9, wherein operating the at least one equipment comprises:

operating the at least one equipment according to an initial control plan;

determining an actual time taken for achieving the target air temperature;

determining a modified control plan when the actual time is not same as the target time; and operating the one or more equipment of the HVAC system according to the modified control plan.

11. The method of claim 10, further comprising:

repeating the steps of determining the actual time, determining the modified control plan and operating the one or more equipment of the HVAC system according to the modified control plan.

12. The method of claim 10, further comprising:

receiving measurements from a plurality of sensors located at multiple locations within the building, wherein each of the sensors is configured to measure at least one of the air temperature in the building or a humidity in the building; and determining at least one of the initial control plan or the modified control plan based on the measurements.

13. The method of claim 9, further comprising:

receiving a heating call or a cooling call from a thermostat; and operating the one or more equipment of the HVAC system to achieve the target air temperature in the target time, in response to receiving the heating call or the cooling call.

14. A system for controlling air temperature in a building, comprising:

one or more equipment associated with a heating ventilation and air-conditioning (HVAC) system; and a controller communicatively coupled to the one or more equipment and configured to:

wirelessly receive from a mobile device as user input a target air temperature and a target time; and operate the one or more equipment of the HVAC system to achieve the target air temperature in the building in the target time.

15. The system of claim 14, wherein:

the one or more equipment of the HVAC system comprises one or more communicating equipment of the HVAC system;

the controller comprises an equipment interface configured to communicate control signals to the one or more equipment to control operation of the one or more equipment; and the equipment interface comprises a communicating equipment interface configured to communicate data with and the control signals to the one or more communicating equipment of the HVAC system.

16. The system of claim 14, wherein:

the one or more equipment of the HVAC system comprises one or more non- communicating equipment of the HVAC system;

the controller comprises an equipment interface configured to communicate control signals to the one or more equipment to control operation of the one or more equipment; and the equipment interface comprises a non-communicating equipment interface configured to communicate the control signals to the one or more non-communicating equipment of the HVAC system.

17. The system of claim 14, further comprising:

a thermostat configured to receive the target air temperature as the user input, wherein the controller further comprises a terminal block communicatively coupled to the thermostat.

18. The system of claim 17, wherein the controller is further configured to:

receive a heating call or a cooling call from the thermostat; and operate the one or more equipment of the HVAC system to achieve the target air temperature in the target time, in response to receiving the heating call or the cooling call.

19. The system of claim 14, wherein the controller further comprises a communication module including a wireless interface capable of wirelessly communicating with one or more devices.

20. The system of claim 19, wherein the wireless interface of the controller includes a Bluetooth interface.

* * * * *